United States Patent [19]

Ando

[11] Patent Number: 4,653,134

[45] Date of Patent: Mar. 31, 1987

[54] CLEANING APPARATUS FOR RAW MATERIAL TRANSFER PIPE

[76] Inventor: Sumio Ando, 21-2, 2 chome, Izuo, Taisho-ku Osaka, Japan

[21] Appl. No.: 723,165

[22] Filed: Apr. 15, 1985

[30] Foreign Application Priority Data

| | | | |
|---|---|---|---|
| Jun. 4, 1984 | [JP] | Japan | 59-114067 |
| Jun. 13, 1984 | [JP] | Japan | 59-121435 |
| Jun. 13, 1984 | [JP] | Japan | 59-87886[U] |
| Feb. 8, 1985 | [JP] | Japan | 60-16757[U] |

[51] Int. Cl.[4] ..... B08B 9/04

[52] U.S. Cl. ..... 15/3.51; 15/104.06 R

[58] Field of Search ..... 15/3.5, 3.51, 104.06 R, 15/104.06 A; 166/70, 153, 155, 156, 291, 170, 177

[56] References Cited

U.S. PATENT DOCUMENTS

| | | | |
|---|---|---|---|
| 1,218,005 | 3/1917 | Schlemmer | 15/104.06 R |
| 2,095,823 | 10/1937 | Marshall | 15/3.51 |
| 3,667,544 | 6/1972 | Allimon | 15/104.06 R |

FOREIGN PATENT DOCUMENTS

| | | | |
|---|---|---|---|
| 52-100754 | 8/1977 | Japan . | |
| 58-45832 | 10/1983 | Japan . | |
| 0680771 | 8/1979 | U.S.S.R. | 15/104.06 R |

*Primary Examiner*—Edward L. Roberts
*Attorney, Agent, or Firm*—Browdy and Neimark

[57] ABSTRACT

This invention relates to an improvement in a cleaning apparatus for a raw material transfer pipe of the type in which a cleaning member having a pressure-receiving recessed region coming into sliding contact with the inner wall of the transfer pipe for transferring a viscous or powdery raw material is fitted into the transfer pipe, and a pressurized fluid is supplied to the pressure-receiving recessed region of the cleaning member to pressure-feed the cleaning member inside the transfer pipe and to wipe off and remove any residue adhering to the wall of the transfer pipe. The present invention disposes integrally spherical guide members having a diameter smaller than the inner diameter of the transfer pipe at the front and rear regions of the cleaning member via elastic reduced diameter shaft regions. Two cleaning members may be coupled to form a pair in the longitudinal direction in such a manner as to maintain a gap greater than the inner diameter of the transfer pipe, and cleaning water jet ports may also be bored on the front spherical guide member. Furthermore, a brush and a sponge may be connected to the rear spherical guide member to further improve efficiency of cleaning.

5 Claims, 9 Drawing Figures

CLEANING APPARATUS FOR RAW MATERIAL TRANSFER PIPE

BACKGROUND OF THE INVENTION

1. Field of the Invention

This invention is concerned primarily with an improvement relating to, or in, a cleaning apparatus for removing any raw material adhering to the inner wall of a raw material transfer pipe for transferring a viscous or powdery raw material.

2. Description of the Prior Art

When viscous raw materials such as thick malt syrup, ice cream, etc, or powdery raw materials such as flour are transferred from a storage tank to a site or to processing equipment through a transfer pipe, it has been standard practice to divide the transfer pipe into small zones and to periodically clean each zone because raw material adheres to the inner wall of the transfer pipe, but disassembling and reassembling the pipe is troublesome and time consuming. Particularly when the raw material to be transferred is foodstuff, cleaning must be done for reasons of sanitation whenever the transfer is complete. Besides the troublesome cleaning, the quantity of the raw material discarded at the time of cleaning is significant; hence, the yield is reduced.

To eliminate the problem described above, the prior art references such as Japanese Utility Model Publication No. 45832/1983 and Japanese Patent Laid-Open No. 100754/1977, for example, propose a system in which a pressure-receiving member for receiving pressurized water is fitted into the transfer pipe, and is pressure-fed by the pressurized water, thereby rinsing off and removing the raw material adhering to the inner wall of the transfer pipe.

However, a problem with a cleaning device of the kind described above is that since a pressure-receiving recessed region of the cleaning member is not curved to match the cross-sectional shape of the transfer pipe at the curved region of the pipe, its contact with the wall on the reduced diameter region of the transfer pipe is not sufficiently close, the pressurized water for the pressure feed leaks from this portion to impede the transfer of the cleaning member, and residue adhering at that region can not be reliably wiped off and removed. If any steps or recesses exist on the inner wall of the transfer pipe, the leakage of the pressurized water takes place at these places, whereby the pressure-feed of the cleaning member is also less effective.

SUMMARY OF THE INVENTION

The present invention is therefore directed to eliminate these drawbacks of the prior art systems. The first characterizing feature of the present invention resides in a cleaning apparatus having a construction in which spherical guide members are integrally formed at the front and rear portions of a cleaning member, that is pressure-fed inside a transfer pipe, via elastic reduced diameter shaft parts, so that the cleaning member can be guided smoothly inside the pipe, and particularly at the curved region of the transfer pipe, the front and rear spherical guide members bend the cleaning member from before and behind with substantially equal force to bring a pressure-receiving recessed portion of the cleaning member into close and reliable contact with the inner wall of the transfer pipe. This arrangement prevents pressurized water from leaking so as to effect pressure-feeding ensures smooth and reliable cleaning by the cleaning member at the bent region, improves the efficiency of cleaning, and recovers the raw material thereby increasing the yield.

The second characterizing feature of the present invention resides in a cleaning apparatus having a construction in which a pair of cleaning members are connected longitudinally by elastic, reduced diameter shaft portions in such a manner as to maintain a gap greater than the inner diameter of the transfer pipe, so that even if any steps or recesses due to a branch or joint exist in the transfer pipe, either of the cleaning members comes into close contact with the inner wall of the transfer pipe so as to maintain the pressure-feed of the cleaning members.

The third characterizing feature of the present invention resides in a cleaning apparatus having a construction in which cleaning water jet ports connected to a cleaning water feed pipe are bored in the front spherical guide members to jet in advance the cleaning water before the cleaning member wipes off and cleans the transfer pipe. This arrangement facilitates smooth wiping and removal of the adhering residue by the cleaning member, eliminates the need to disassemble the pipe, and makes it possible to mix a disinfectant or a solvent for the residue in the cleaning water. Therefore, this apparatus can further improve the efficiency of cleaning a transfer pipe, particularly a transfer pipe for transferring a powdery material.

The fourth characterizing feature of the present invention resides in a cleaning apparatus having a construction in which pressurized water jet ports connected to a pressurized water feed pipe are bored at the front part of the rear spherical guide member of the cleaning member, and the high pressure pressurized water is jetted from the pressurized water jet ports so that the elastic pressure-receiving member can be pressure-fed and at the same time, the inner wall of the transfer pipe can be washed and cleaned. This arrangement can reliably remove and clean the raw material adhering particularly at the steps or recesses of the joint regions of the transfer pipe, by means of the pressurized water without dissolving the raw material.

DESCRIPTION OF THE PREFERRED EMBODIMENTS

Hereinafter, the present invention will be described in detail with reference to some preferred embodiments thereof.

Figure 1:
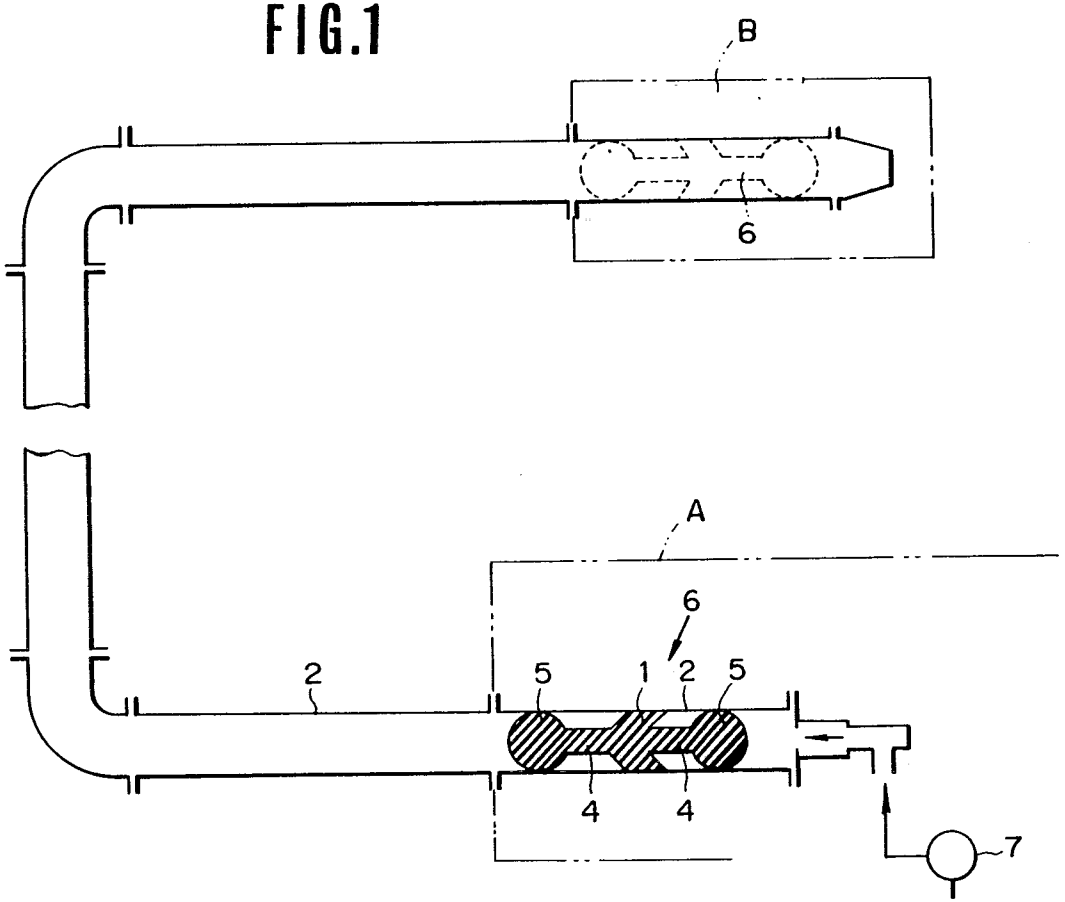
FIG. 1 is a schematic view showing the mode of cleaning in accordance with the present invention.
Figure 2:
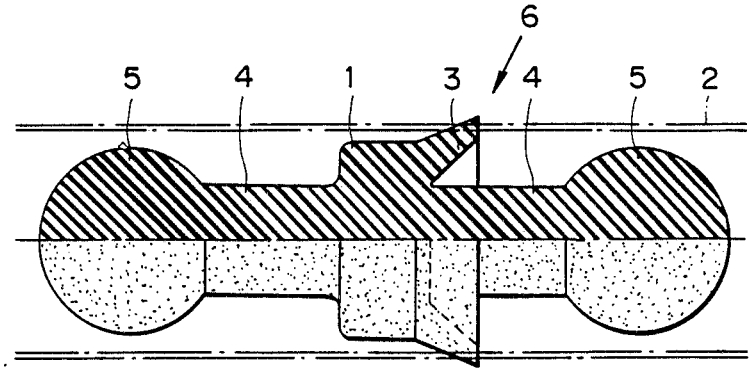
FIG. 2 is a front view of a cleaning member of the present invention with a cross-section of the upper half.
Figure 3:
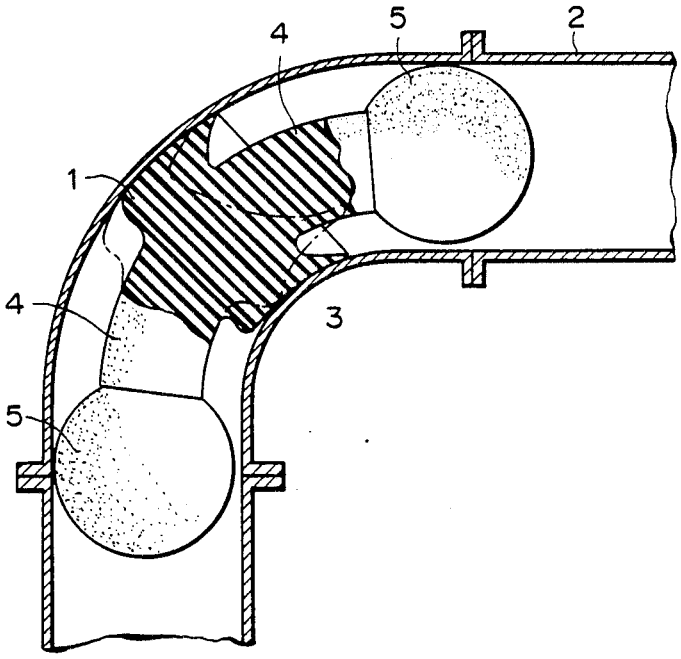
FIG. 3 is a front view of the cleaning member of the present invention with the curved region of a raw material transfer pipe being cut away.

In FIGS. 1 through 3, a cleaning member 1 is made of an elastic material such as synthetic rubber, soft synthetic resin, or the like. A pressure-receiving recessed region 3 having a diameter slightly greater than the inner diameter of a raw material transfer pipe 2 is integrally formed at the rear of the cleaning member 1. Reduced diameter shaft regions 4, 4 are formed by the same elastic material at the front and rear parts of the cleaning member 1, and spherical guide members 5, 5 having a diameter a little smaller than the inner diameter of the transfer pipe 2 and made of the same elastic material are integrally disposed at the tips of these reduced diameter shaft portions 5, 5. These members 1 through 5 together constitute a cleaner 6.

The cleaner 6 is fitted into the base region of the raw material transfer pipe 2 connecting, for example, a tank A to a treating machine B. When pressurized water is supplied by a pump 7 from the base end of the pipe, the pressurized water acts upon the pressure-receiving recessed region 3 of the cleaning member 1, brings it into close contact with the inner wall of the transfer pipe 2 and pressure-feeds the cleaner 6. In this case, the pressure-receiving recessed region 3 wipes off and removes any raw material adhering to the pipe, while the front spherical guide member 5 guides the cleaning member 1.

When the cleaner 6 is pressure-fed to the curved region of the transfer pipe 2, the cleaning member 1 is curved substantially uniformly from before and behind by the front and rear spherical guide members 5 and 5 as can be seen from FIG. 3, and the pressure-receiving recessed portion 3 undergoes deformation substantially to the cross-sectional shape of the bent portion so that it accurately adheres particularly to the wall on the reduced diameter side, too, and reliably wipes off and removes any adhering residue at the curved region.

Figure 4:
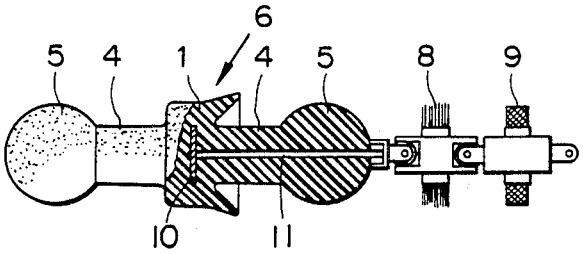
FIG. 4 is a partially cut-away front view of the cleaning member is accordance with the present invention.

FIG. 4 shows another embodiment of the present invention, in which a brush 8 and a sponge 9 are further connected to the rear of the cleaner 6 by an anchor plate 10 and a rope 11 that are buried in the rear spherical guide member 5 so that any residue adhering firmly to the wall can be cleaned and removed by the brush 8 and the sponge 9.

Figure 5:
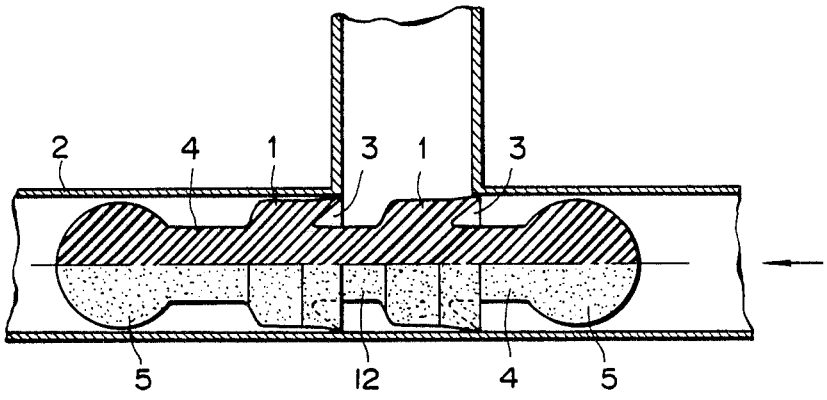
FIG. 5 is a front view of a cross-section of the upper half of the cleaning member in accordance with another embodiment of the present invention.

FIG. 5 shows still another embodiment of the present invention, in which the cleaning members 1 and 1 are integrally connected in the longitudinal direction by an elastic reduced diameter shaft portion 12 in such a manner as to retain a gap greater than the inner diameter of the transfer pipe 2, and the spherical guide members 5, 5 are connected integrally and continuously to the front part of the front cleaning member 1 and to the rear part of the rear cleaning member 1 via the elastic reduced diameter shaft portions 4, 4, respectively, thereby forming the cleaner 6 of this embodiment. Even when any branch portion 11 or recesses due to joint means exist, this arrangement brings the pressure-receiving recessed portion 3 of either of the front and rear cleaning members 1 into close contact with the wall surface, so that the leakage of the pressurized water can be prevented, and the loss of efficiency of the pressure-feed operation of the cleaner 6 by the pressurized water can be prevented.

Figure 6:
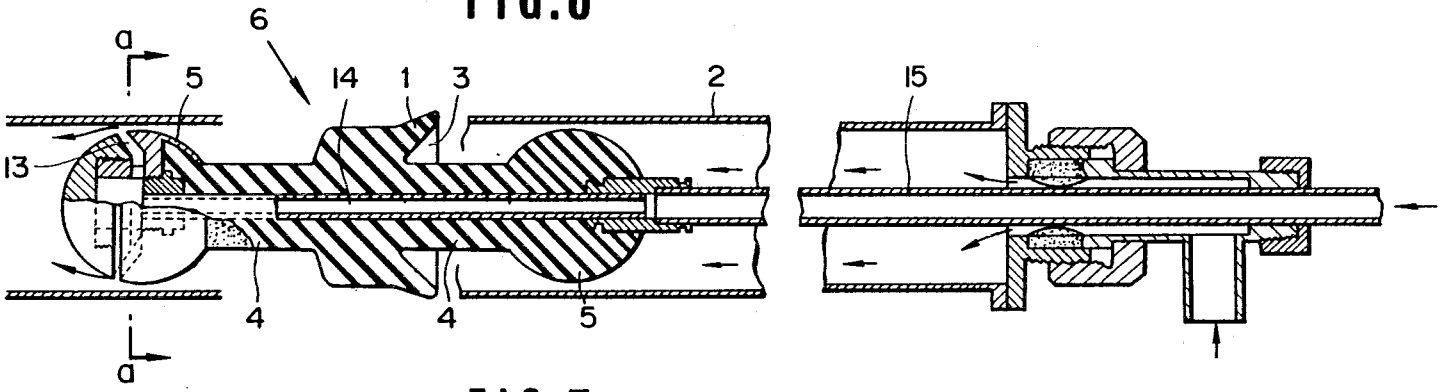
FIG. 6 is a front view, partly in cross-section of still another embodiment of the present invention.
Figure 7:
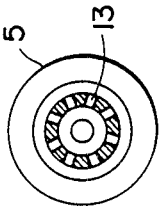
FIG. 7 is a sectional view of the cleaning member taken along line a—a in FIG. 6.
Figure 8:
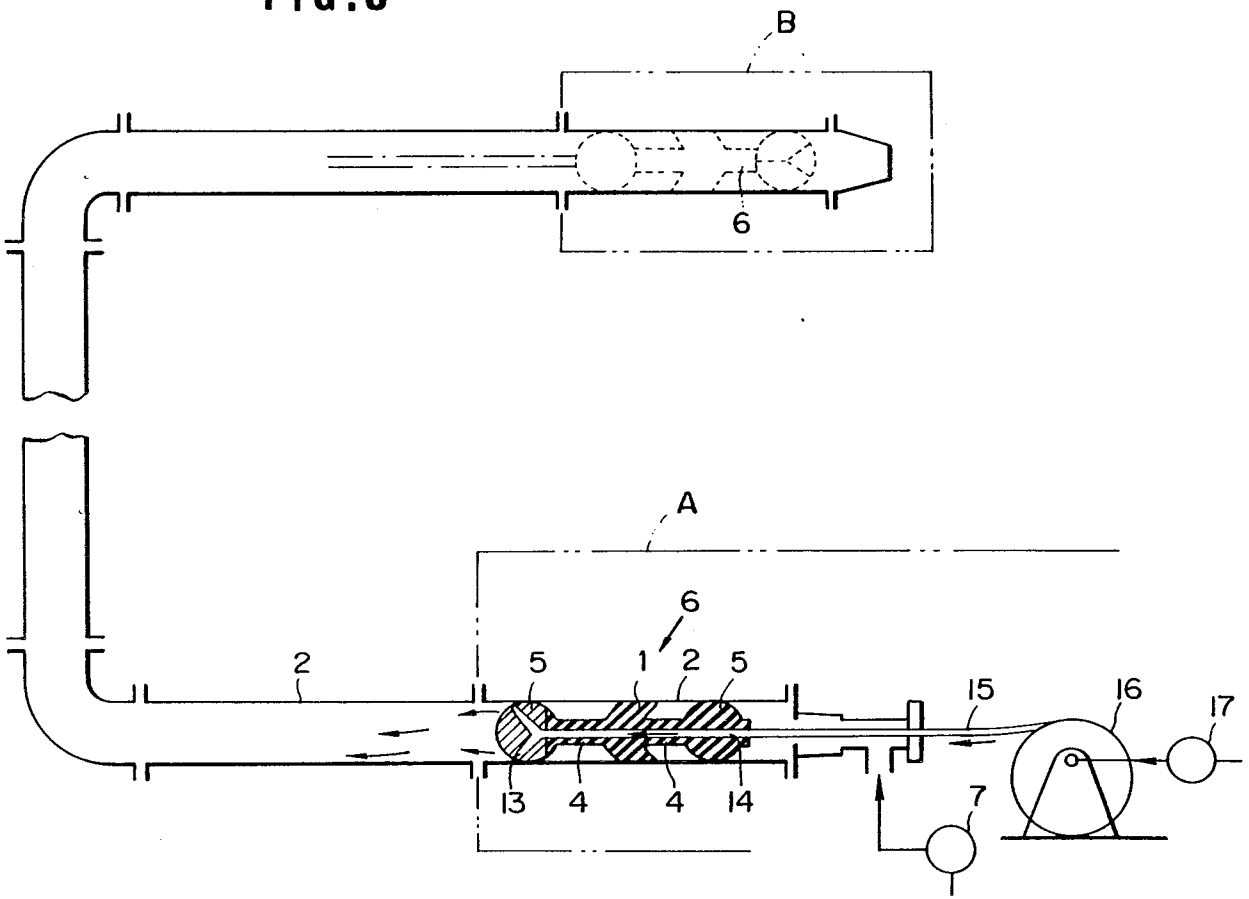
FIG. 8, is a schematic view showing the mode of cleaning in the embodiment shown in FIG. 6.

In still another embodiment of the present invention shown in FIGS. 6 through 8, cleaning water jet ports 13 are bored at a portion of the front spherical guide member 5 which is made of metal, and is detachably connected to a cleaning water feed pipe 15 connected to the rear spherical guide member 5 through a pipe 14 that penetrates through the elastic reduced diameter portions 4, 4, the cleaning member 1 and the rear guide member 5. The cleaning water feed pipe 15 is wound on a reel 16 disposed outside the base end of the transfer pipe 2, and is delivered simultaneously with the pressure-feed operation of the cleaner 6 so that the cleaning water is jetted from the jet ports 13 by the pump 17, and the cleaning member 1 wipes off and removes any adhering residue while the wall ahead of the cleaner 6 is being washed in advance. The cleaner of this embodiment is particularly effective for cleaning the transfer pipe of a powder material, and a disinfectant and a solvent for the powdery material can be mixed into the cleaning water.

Figure 9:
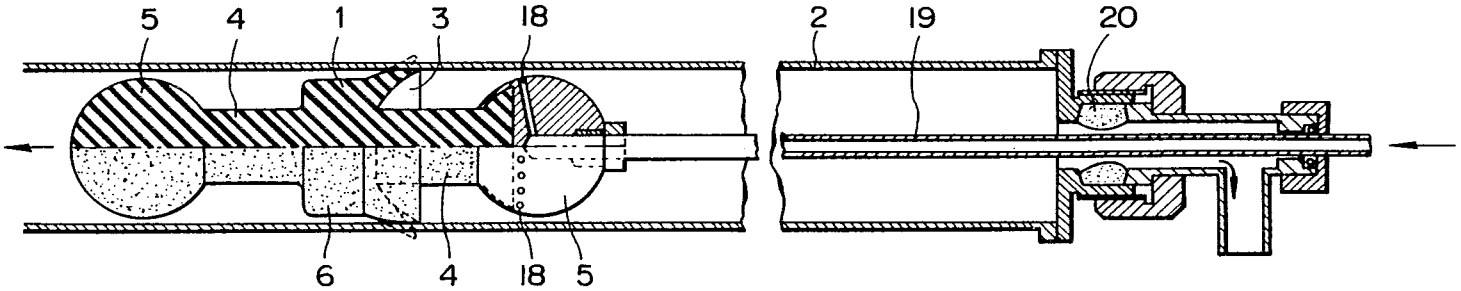
FIG. 9 is a front view, partly in cross-section, showing still another embodiment of the present invention.

FIG. 9 shows a further embodiment of the present invention, wherein the pressurized water jet ports 18 are bored forwardly at a region of the rear spherical guide member 5 which is made of a metal, and are connected to a pressurized water feed pipe 19 inserted extensibly into the base portion of the transfer pipe 2 so that the high pressure pressurized water jetting from the jet ports 18 acts upon the pressure-receiving recessed region 3, and the cleaner 6 is thus pressure-fed into the transfer pipe 2 and removes any adhering residue. At the same time, the high pressure pressurized water directly washes the wall surface and removes the adhering residue, thereby facilitating cleaning. Drain regulating means 20 is disposed at the base end of the transfer pipe 2 to regulate the drain quantity as well as the transfer speed of the cleaner 6.

Although the invention has thus been described in its some preferred forms, it is understood that the present invention is not particularly limited thereto, and can be practised in various ways within the scope of the appended claims.

What is claimed is:

1. In a cleaning apparatus for a raw material transfer pipe, said apparatus having a front region and a rear region, an elastic first cleaning portion positioned between said front and rear regions, said cleaning portion having a pressure-receiving recessed area for coming into sliding contact with an inner wall of said raw material transfer pipe, said apparatus being adapted to fit into said transfer pipe, and means for supplying a pressurized fluid to said pressure-receiving recessed area of said cleaning portion adapted to receive a pressurized fluid for pressure-feeding said first cleaning portion inside said transfer pipe and to wipe off and remove any residue adhering to the wall of said transfer pipe, the improvement comprising spherical guides, having a diameter smaller than the inner diameter of said transfer pipe, joined to the front and rear regions of said cleaning portion by elastic reduced diameter shafts.

2. The cleaning apparatus of claim 1 wherein a second elastic cleaning portion is positioned between said front and rear spherical guides and longitudinally joined to said first elastic cleaning portion by an elastic reduced diameter shaft in such a manner as to maintain a gap between said first and second elastic cleaning portions greater than the inner diameter of said transfer pipe.

3. The cleaning apparatus of claim 1, wherein cleaning jet ports are positioned on said front spherical guide, a conduit extends from said rear spherical guide, through first elastic cleaning portion, to said cleaning water jet ports, said conduit being in communication with said cleaning water ports, and a cleaning water feed pipe is connected to said conduit and is longitudinally extendable so as to extend from a source of cleaning water to said conduit, said cleaning water jet ports being adapted to project water forward of said front spherical guide.

4. The cleaning apparatus of claim 1, wherein pressurized water jet ports are positioned on said rear spherical guide member in such a manner as to face said pressure-receiving recessed region of said first cleaning portion, and a pressurized extendable water feed pipe is connected to said pressurized water jet ports. the base region of said transfer pipe is connected to said pressurized water jet ports.

5. The cleaning apparatus for a raw material transfer pipe as defined in claim 1 wherein a brush and a sponge are connected to the rear of said rear spherical guide member.

* * * * *